US005555654A

United States Patent [19]

Hermann

[11] Patent Number: 5,555,654

[45] Date of Patent: Sep. 17, 1996

[54] FRAMES HAVING LIGHTING TO ILLUMINATE GLASS ETCHINGS

[76] Inventor: Mark D. Hermann, 106 Mainsail Ct., Folsom, Calif. 95630

[21] Appl. No.: 332,585

[22] Filed: Oct. 31, 1994

[51] Int. Cl.[6] ..... G09F 13/00

[52] U.S. Cl. ..... 40/714; 40/546; 362/31

[58] Field of Search ..... 40/152, 152.2, 40/546, 547, 572; 362/31, 255, 216, 294

[56] References Cited

U.S. PATENT DOCUMENTS

| | | | |
|---|---|---|---|
| 2,731,749 | 1/1956 | Tarzian . | |
| 3,270,451 | 9/1966 | Bartleson et al. . | |
| 3,318,032 | 5/1967 | Robison et al. . | |
| 3,790,772 | 2/1974 | Newman et al. | 40/573 X |
| 4,386,476 | 6/1983 | Schulman . | |
| 4,922,384 | 5/1990 | Torrence | 40/152.2 X |
| 5,161,884 | 11/1992 | Siminovitch | 362/294 |
| 5,165,783 | 11/1992 | Barron, Sr. . | |
| 5,265,357 | 11/1993 | Yu | 40/152.2 |
| 5,295,221 | 3/1994 | Roslan | 40/547 X |
| 5,313,724 | 5/1994 | Warner . | |
| 5,371,656 | 12/1994 | Iorfida | 40/152.2 |

FOREIGN PATENT DOCUMENTS

| | | |
|---|---|---|
| 4181285 | 6/1992 | Japan . |

*Primary Examiner*—Brian K. Green

*Attorney, Agent, or Firm*—Thomas I. Rozsa; Tony D. Chen; Tony D. Chen

[57] ABSTRACT

The present invention is an illuminating frame which is used for holding and displaying paintings, drawings, lithographs or artworks. It utilizes a strip of light to illuminate a plurality of glass etchings which are retained within the frame. The strip of light is sitting on an interior ledge of the frame. By having the strip of light around the entire interior circumference of the frame, the strip of light provides a nice visual effect on the glass etchings. The frame can accommodate more glass etchings if so desired.

21 Claims, 2 Drawing Sheets

FRAMES HAVING LIGHTING TO ILLUMINATE GLASS ETCHINGS

BACKGROUND OF THE INVENTION

1. Field of The Invention

The present invention relates to the field of picture frames. More particularly, the present invention relates to the field of special frames in different sizes, in which a strip of light can be positioned into a portion of the frame for illuminating glass etchings which are retained within the frame.

2. Description of The Prior Art

Generally, the prior art illumination frames have typically utilized a bulb member positioned above or below an associated picture to provide illumination thereon. Other prior art frames are either furnished with an exteriorly located lamp hanging over the frame or lamps incorporated within the outer frame or attached to the outer frame for illuminating the picture within the frame. One of the disadvantages with the prior art frames is that they require mounting means and fastening means to support the lamps for illuminating the picture within the frame. They are also very cumbersome and difficult to handle for someone who is not mechanically inclined. Another disadvantage with the prior art frames is that they require vent openings thereto for allowing heat generated by the lights to escape from the frame. The frames with vent openings are not artistically pleasing to the consumers. Other types of picture frames are simply used for directing light on the picture.

The following seven (7) prior art patents were uncovered in the pertinent field of the present invention:

1. U.S. Pat. No. 2,731,749 issued to Tarzian on Jan. 24, 1956 for "Means Of Displaying Pictures" (hereafter "the Tarzian Patent");

2. U.S. Pat. No. 3,270,451 issued to Bartleson et al. on Sep. 6, 1966 for "Method And Apparatus For Exhibiting A Display" (hereafter "the Bartleson Patent");

3. U.S. Pat. No. 3,318,032 issued to Robison et al. on May 9, 1967 for "Illuminated Display Frame" (hereafter "the Robison Patent");

4. U.S. Pat. No. 4,386,476 issued to Schulman on Jun. 7, 1983 for "Edge Lighted Display Sign" (hereafter "the Schulman Patent");

5. U.S. Pat. No. 5,165,783 issued to Barron, Sr. on Nov. 24, 1992 for "Picture Frame Mounted Illuminating Device" (hereafter "the Barron Patent");

6. U.S. Pat. No. 5,313,724 issued to Warner on May 24, 1994 for "Picture Frame Illumination Apparatus" (hereafter "the Warner Patent"); and 7. Japanese Patent No. 4-181,285 for "Illuminated Frame" (hereafter "the '285 Japanese Patent").

The Tarzian Patent discloses an illuminated picture display. It includes a frame with a curved transparent plate having the foreground portion of a picture attached to its surface and a flat transparent plate having the background of the picture attached to it. It also has two lamps which are secured in front of the flat background plate located on the top wall and in back of the curved transparent plate located on the bottom wall.

The Bartleson Patent discloses a method and apparatus for exhibiting a display. A reflection-type color reproduction is mounted on a frame with the surface of the reproduction lying in the same plane defined by the peripheral edge of the opening of the housing. A light trough is carrying a plurality of high intensity lamps and is located adjacent the lowermost edge of the opening of the housing to uniformly illuminate the entire surface of the print.

The Robison Patent discloses an illuminated display frame. It includes a frame assembly comprising an outer frame, an insert, light diffusing prismatic lists, a picture to be displayed in the outer frame, a backing board, and a housing which contains light sources for illuminating the picture. The light bulbs are arranged along the inner walls of the flanges of the housing. When all the elements of the illuminated frame have been assembled and positioned substantially in height with and adjacent the light diffusing prismatic lists, the lists will transmit and disperse the light coming from the light source evenly over the entire front surface of the displayed picture.

The Schulman Patent discloses an edge lighted display sign. It includes a base portion which defines a housing for a light source and a variable duty cycle oscillator which includes a ratio control device projecting exteriorly of the base. The light source is controlled from an "off" position for light tube to a constant "on" position, through a complete range of blinking speeds.

The Barron Patent discloses a picture frame which is mounted to an illuminating device. It includes a light fixture having a bracket for attachment to the picture frame and a shelf portion to project forwardly from the frame.

The Warner Patent discloses a picture frame illumination apparatus. It includes a multi-sided central support plate with a housing coextensively and continuously mounted about the periphery of the central support plate. The housing is formed with four housing members. The top housing member has a top plate with a plurality of vent openings to direct heat away from the housing. Each housing member has an illumination bulb which is mounted therein and a transparent lens in contiguous and coextensive communication with each edge of the central support plate, wherein illumination of each illumination bulb directs illumination onto the central support plate through each respective transparent lens.

The '285 Japanese Patent discloses an illumination frame. A reflection plate is formed as a parabolic surface shape so as to reflect the light from the fluorescent lamp forward in a nearly parallel state. A light diffusion panel has a light transparent prism structure which is provided on the rear surface of the fluorescent lamp. The light transparent picture and a half mirror are successively superposed and provided on the front surface of the panel.

It is highly desirable to have a very efficient and also very effective design and construction of a new and improved illuminating frame which can accommodate a plurality of glass etchings and has a strip of light sitting on an interior ledge of the frame and surrounding the interior circumference of the frame, which somewhat functions as backlights and sidelights for the glass etchings to produce the nice visual effect. The light strip surrounds the glass etchings and has a very beautiful visual effect when the light is illuminating the glass etchings. It is desirable to have an illuminating frame which eliminates the need of any vent openings thereto for allowing heat generated by the light source to escape.

SUMMARY OF THE INVENTION

The present invention is an illuminating frame which utilizes a strip of light to illuminate a plurality of glass etchings which are retained within the frame. The glass etchings are to be inserted into the frame. The novelty of the illuminating frame is that the frame can accommodate more glass etchings if so desired.

The primary objective of the present invention is to have a strip of light sitting on an interior ledge of the frame. By having the light strip around the entire interior circumference of the frame, the light strip itself has a nice visual effect on the glass etchings. The strip of light surrounds the glass etchings and has a very beautiful visual effect when the light is plugged in and turned on. An artwork and glass etchings can also be used as a backdrop when framing a motion picture cell.

It has been discovered, according to the present invention, that by providing a frame which can accommodate a plurality of glass etchings and a strip of light completely surrounding the entire interior circumference of the frame, the strip of light will provide a nice visual effect on the glass etchings when the light is plugged in and turned on.

It has further been discovered, according to the present invention, that by providing a strip of light which is enclosed by a heat resistance material such as resin material, it will provide means for absorbing most of the heat generated by the strip of light without requiring vent openings on the frame.

It is therefore an object of the present invention to provide a new and improved illuminating frame which is of a durable and reliable construction.

It is also an object of the present invention to provide a new and improved illuminating frame which is easily and efficiently manufactured, and conforms to conventional forms of manufacture.

It is an additional object of the present invention to provide an illuminating frame which can accommodate a plurality of glass etchings, so that the glass etchings can be used as a backdrop when framing a motion picture cell.

It is a further object of the present invention to provide an illuminating frame having a strip of light completely surrounding the entire interior circumference of the frame, so that the strip of light provides a very beautiful visual effect on the glass etchings when the light is plugged in and turned on.

It is an additional object of the present invention to provide an illuminating frame having a strip of light which is enclosed by a heat resistance material such as resin material, so that the resin material absorbs most of the heat generated by the strip of light and the frame does not require vent openings for allowing the heat to escape.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
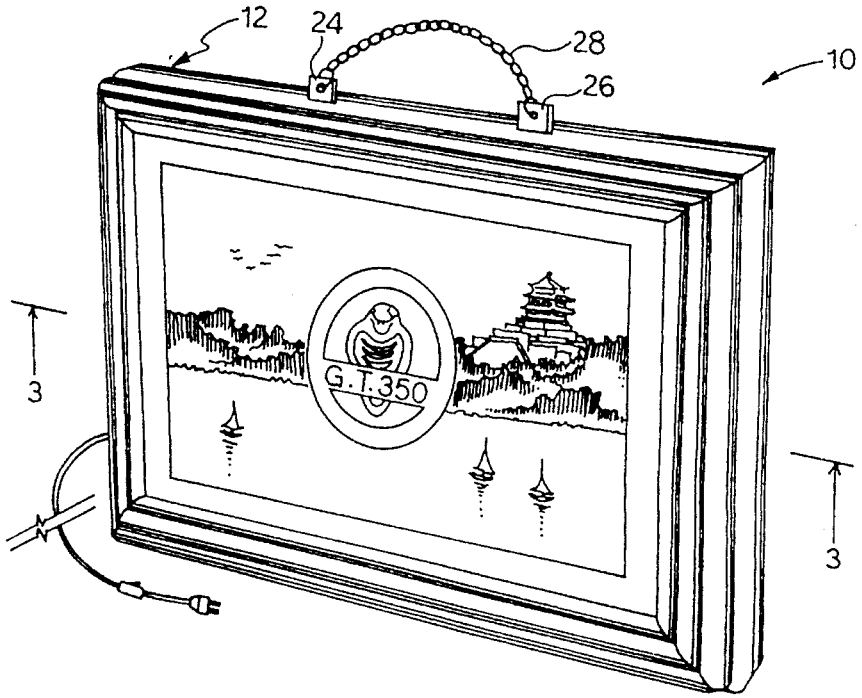
FIG. 1 is a perspective view of the present invention illuminating frame.
Figure 3:
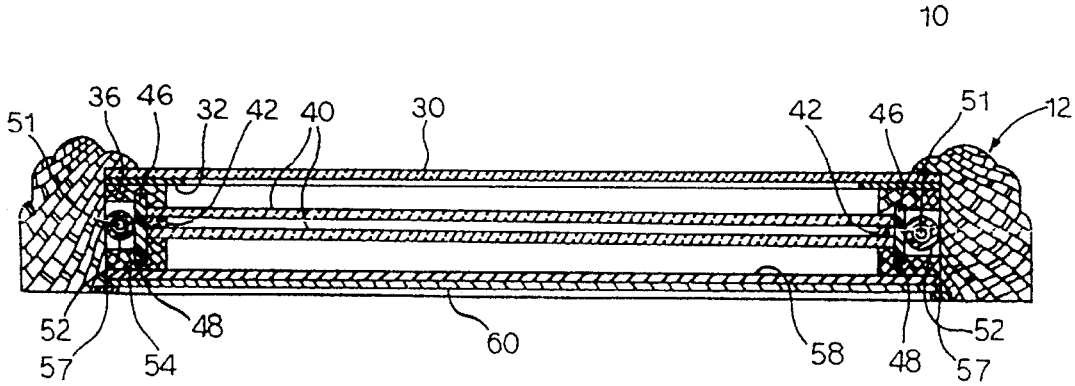
FIG. 3 is a cross-sectional view taken along line 3—3 of FIG. 1.
Figure 2:
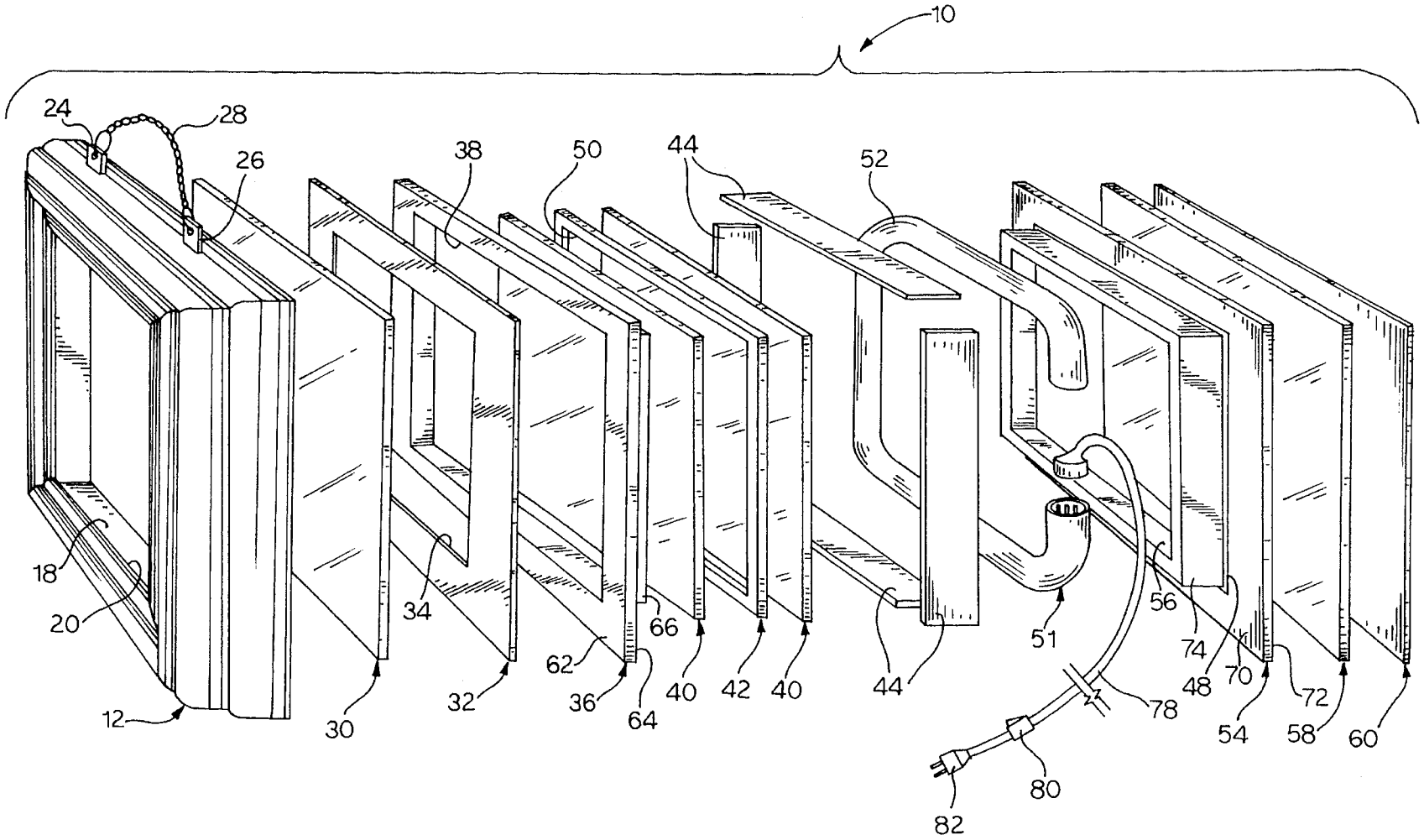
FIG. 2 is an exploded perspective view of the present invention illuminating frame.

Referring to FIG. 1, there is shown at 10 a perspective view of the preferred embodiment of the present invention illuminating frame for holding and displaying paintings, drawings, lithographs or artworks. The illuminating frame 10 is generally a rectangular shaped structure, but it may be in a square, oval, round or any other shape if desirable. The illuminating frame 10 can also hold and display a plurality of glass etchings as shown in FIGS. 2 and 3. By way of example only, FIG. 1 illustrates the etching of a cobra with letters and numbers beneath it. The artwork is utilized for the background of the cobra.

It will be appreciated that the cobra shown above is merely one illustrative embodiment and the present invention can include many other illustrations. The present invention conforms to conventional forms of manufacture and is easy to use.

Figure 4:
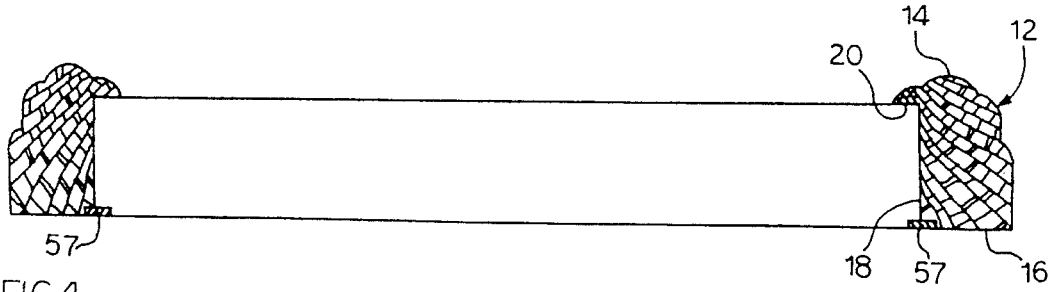
FIG. 4 is a cross-section view of the outer frame member alone.

Referring to FIGS. 1 and 4, the illuminating frame 10 includes a rectangular shaped rigid outer frame member 12 which has a front side 14, a back side 16 and a generally rectangular shaped central cavity 18 therethrough, wherein a rearward facing inner shelf or ledge 20 is provided adjacent to the front side 14. At the top of the frame 10, there are two hanging members 24 and 26 such as small round eyelets for hanging the frame 10 onto the wall. In addition, optional chain 28 can be used to suspend the frame 10 from the wall or from an upper area such as a shelf or ceiling.

It will be appreciated that the two hanging members 24 and 26 of the present invention illustrates only one method for hanging the frame 10 onto the wall. It is also within the spirit and scope of the present invention to utilize other possible means for hanging the frame 10 onto the wall, shelf or ceiling.

Referring to FIG. 2, there is illustrated an exploded view of the present invention illuminating frame 10 shown in FIG. 1. From left to right there is shown the outer frame member 12, a rectangular shaped transparent window member 30, a rectangular shaped perimeter insert or border member 32 which has a rectangular shaped central opening 34, a rectangular shaped front inner frame member 36 which also has a rectangular shaped central opening 38, a plurality of glass etchings 40, an edge spacer member 42 which also has a rectangular shaped central opening 50, four elongated thin transparent support spacer members 44, a generally elongated flexible light strip 51 bent into a generally rectangular shaped frame arrangement, a rectangular shaped rear inner frame member 54 which also has a rectangular shaped central opening 56, a background artwork 58 and a rectangular shaped backing member 60. All of the pieces are assembled together symmetrically as shown in FIG. 3 and secured within the outer frame member 12 by securing means 57. The securing means 57 may be diamond points which are conventional in the art. The illuminating frame 10 may be assembled with at least one glass etching 40 therein or without the glass etching 40. By way of example, the outer frame member 12 may be made of hard wooden material such as solid oak. The outer frame member 12 may also be made of plastic material or light metal material such as aluminum. The transparent window member 30 and the glass etchings 40 may be made of glass. The edge spacer member 42 and the transparent support spacer members 44 may be made of plastic material or Plexiglas.

FIG. 3 shows a cross-sectional view of the present invention illuminating frame 10. Referring to FIGS. 2 and 3, the transparent window member 30 is assembled between the rearward facing shelf 20 of the outer frame member 12 and the perimeter insert 32, and thereby forming the front side 14 of the frame 10. The front inner frame member 36 also has a front side 62, a back side 64 and a rearward extending portion 66 which extends rearwardly and away from the back side 64 and also surrounds the central opening 38. There is also a narrow groove (not shown) on the back side 64 and surrounding the rearward extending portion 66 for allowing the transparent support spacer members 44 to be inserted and engaged therein. The front inner frame member 36 is assembled within the cavity 18 such that the front side 62 is adjacent to the perimeter insert 32.

The rear inner frame member 54 also has a front side 70, a back side 72, a forward extending portion 74 which extends forwardly and away from the front side 70 and surrounds the central opening 56. There is also a narrow groove 48 (shown in FIG. 3) on the front side 70 and surrounding the forward extending portion 74 for allowing the transparent support spacer members 44 to be inserted and engaged therein.

The plurality of glass etchings 40 are assembled between the rearward extending portion 66 and the forward extending portion 74. Also utilized with the plurality of glass etchings 40 are a plurality of edge spacer members 42 (only one is shown) which are inserted between the glass etchings 40 for providing spacing therebetween. If more than three glass etchings 40 are assembled within the cavity 18 of the outer frame member 12, then two or more edge spacer members 42 are needed. If only one glass etching 40 is assembled within the cavity 18 of the outer frame member 12, then the edge spacer 42 is not required. The plurality of glass etchings 40 conforms to conventional methods of manufacture.

The four elongated transparent support spacer members 44 are assembled between the front and the rear inner frame members 36 and 54 respectively. These support spacer members 44 are inserted and engaged within the respective narrow grooves 46 and 48 of the front and rear inner frame members 36 and 54, as shown in FIG. 3.

The flexible light strip 51 or illuminating means is assembled between the front and rear inner frame members 36 and 54. The light strip 51 is assembled and sitting between the rear side 64 of the front inner frame member 36 and the front side 70 of the rear inner frame member 54, and surrounds the four transparent support spacer members 44 for illuminating the plurality of glass etchings 40 to provide a nice visual effect. There is also provided means for electrically powering the light strip 51. The light strip 51 has an electrical cord 78 and an outlet plug 82 which can be plugged into a conventional wall outlet. A power switch 80 is also provided for turning "on" and "off" the light strip 51. The electrical cord 78 can be routed out through small narrow openings on the rear inner frame member 54 and the backing member 60 respectively or any other conventional means. The light strip 51 can be covered by a heat resistance material 52 such as resin material for absorbing heat generated by the light strip 51 when it is activated. This is why the illuminating frame 10 does not require any vent openings thereon.

When the light strip 51 is illuminating, the plurality of glass etchings 40 can be viewed through the transparent window member 30. The light strip 51 surrounds the glass etchings 40 and provides a very beautiful visual effect on the plurality of glass etchings 40. The light strip 51 functions as both backlights and sidelights for the glass etchings 40 to produce the nice visual effect.

The backing member 60 is assembled adjacent to the back side 72 of the rear inner frame member 54 such that an artwork background 58 can be inserted between the rear inner frame member 54 and the backing member 60 for providing a background for the glass etchings 40. When the backing member 60 is assembled, it forms the rear side 16 of the frame 10.

One of the unique features of the present invention frame 10 is that it can accommodate more glass etchings 40 if so desired.

Another feature of the present invention frame 10 is that it does not require any vent openings for allowing heat to escape from the frame 10 because the light strip 51 is covered by resin material 52 which absorbs most of the heat generated by the light strip 51.

Defined in detail, the present invention is a frame for displaying one or more glass etchings with an artwork as background, comprising: (a) an outer frame member having a front side, a back side and a central cavity therethrough, wherein a backward facing inner shelf is provided adjacent to the front side; (b) a front inner frame member shaped to be fitted within said cavity of said outer frame member and having a front side, a back side, a central opening therethrough, and a backward extending part surrounding the central opening and extending backwardly and away from the back side, the back side having a narrow groove surrounding the backward extending part; (c) a front transparent member shaped to be fitted within said cavity of said outer frame member and assembled between said inner shelf of said outer frame member and said front side of said front inner frame member; (d) a back inner frame member shaped to be fitted within said cavity of said outer frame member and having a front side, a back side, a central opening therethrough, and a forward extending part surrounding the central opening and extending forwardly and away from the front side, the front side also having a narrow groove surrounding the forward extending part; (e) said backward extending part of said front inner frame member and said forward extending part of said back inner frame member holding said one or more glass etchings therebetween; (f) at least one transparent spacer member inserted into said narrow groove on said back side of said front inner frame member and said narrow groove on said front side of said back inner frame member and thereby held in position and surrounding said one or more glass etchings; (g) an elongated flexible light strip bent and positioned between said back side of said front inner frame member and said front side of said back inner frame member and surrounding said at least one transparent spacer member for illuminating said one or more glass etchings through said at least one transparent spacer member; (h) said light strip covered by a heat resistance material for absorbing heat generated by said light strip; (i) a backing member also shaped to be fitted within said cavity of said outer frame member and positioned adjacent to said back side of said outer frame member for holding said artwork background between said back side of said back inner frame member and the backing member; and (j) means for securing said backing member to said outer frame member; (k) whereby said one or more glass etchings with said artwork background can be view through the front transparent member with surrounding illumination from said light strip.

Defined broadly, the present invention is a frame for displaying at least one glass etching with an artwork as background, comprising: (a) an outer frame member having a front side, a back side and a cavity therethrough, wherein a backward facing inner edge is provided adjacent to the front side; (b) a first inner frame member shaped to be fitted within said cavity of said outer frame member and having a front side, a back side, an opening therethrough, and a first extending portion surrounding the opening; (c) a transparent member shaped to be fitted within said cavity of said outer frame member and assembled between said inner edge of said outer frame member and said front side of said first inner frame member; (d) a second inner frame member shaped to be fitted within said cavity of said outer frame member and having a front side, a back side, an opening therethrough, and a second extending portion surrounding the opening; (e) said first extending portion of said first inner frame member and said second extending portion of said second inner frame member holding said at least one glass etching therebetween; (f) at least one spacer member positioned between said back side of said first inner frame member and said front side of said second inner frame member, and thereby held in position and surrounding said at least one glass etching; (g) an illuminating means positioned between said back side of said first inner frame member and said front side of said second inner frame member and surrounding said at least one spacer member for illuminating said at least one glass etching through said at least one spacer member; (h) means for covering said illuminating means for adsorbing heat generated therefrom; (i) a backing member also shaped to be fitted within said cavity of said outer frame member and positioned adjacent to said back side of said outer frame member for holding said artwork background between said back side of said second inner frame member and the backing member; and (j) means for securing said backing member to said outer frame member; (k) whereby said at least one glass etching with said artwork background can be view through said transparent member with surrounding illumination from said illuminating means.

Defined more broadly, the present invention is a frame for displaying at least one glass etching with an artwork, comprising: (a) an outer frame member having a front surface and a cavity therethrough, wherein an inner edge is provided adjacent to the front side; (b) a first inner frame member assembled within said cavity of said outer frame member and having an opening therethrough; (c) a transparent member assembled within said cavity of said outer frame member and located between said inner edge of said outer frame member and said first inner frame member; (d) a second inner frame member assembled within said cavity of said outer frame member and having an opening therethrough; (e) said first inner frame member and said second inner frame member holding said at least one glass etching therebetween; (f) an illuminating means positioned between said first inner frame member and said second inner frame member for illuminating said at least one glass etching, and having means for absorbing heat generated therefrom; (g) a backing member assembled within said cavity of said outer frame member for holding said artwork between said second inner frame member and the backing member; and (h) means for securing said backing member to said outer frame member; (i) whereby said at least one glass etching with said artwork can be view through said transparent member with surrounding illumination from said illuminating means.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A frame for displaying one or more glass etchings with an artwork as background, comprising:

a. an outer frame member having a front side, a back side and a central cavity therethrough, wherein a backward facing inner shelf is provided adjacent to the front side;

b. a front inner frame member shaped to be fitted within said cavity of said outer frame member and having a front side, a back side, a central opening therethrough, and a backward extending part surrounding the central opening and extending backwardly and away from the back side, the back side having a narrow groove surrounding the backward extending part;

c. a front transparent member shaped to be fitted within said cavity of said outer frame member and assembled between said inner shelf of said outer frame member and said front side of said front inner frame member;

d. a back inner frame member shaped to be fitted within said cavity of said outer frame member and having a front side, a back side, a central opening therethrough, and a forward extending part surrounding the central opening and extending forwardly and away from the front side, the front side also having a narrow groove surrounding the forward extending part;

e. said backward extending part of said front inner frame member and said forward extending part of said back inner frame member for holding said one or more glass etchings therebetween;

f. at least one transparent spacer member inserted into said narrow groove on said back side of said front inner frame member and said narrow groove on said front side of said back inner frame member and for holding in position and surrounding said one or more glass etchings;

g. an elongated flexible light strip bent and positioned between said back side of said front inner frame member and said front side of said back inner frame member and surrounding said at least one transparent spacer member for illuminating said one or more glass etchings through said at least one transparent spacer member;

h. said light strip covered by a heat resistance material for absorbing heat generated by said light strip;

i. a backing member also shaped to be fitted within said cavity of said outer frame member and positioned adjacent to said back side of said outer frame member for holding said artwork as said background between said back side of said back inner frame member and the backing member; and j. means for securing said backing member to said outer frame member.

2. The frame as defined in claim 1 further comprising a perimeter insert shaped to be fitted within said cavity of said outer frame member and having a central opening therethrough, and assembled between said front transparent member and said front side of said front inner frame member.

3. The frame as defined in claim 1 further comprising two hanging members for hanging the frame.

4. The frame as defined in claim 1 further comprising one or more edge spacer members shaped to be fitted within said cavity of said outer frame member and having a central opening therethrough, and assembled between said one or more glass etchings for spacing them apart.

5. The frame as defined in claim 1 wherein said heat resistance material of said light strip is resin material.

6. The frame as defined in claim 1 wherein said front transparent member is made of glass.

7. The frame as defined in claim 1 wherein said outer frame member is made of wooden material.

8. The frame as defined in claim 1 wherein said outer frame member is generally a rectangular shape.

9. A frame for displaying at least one glass etching with an artwork as background, comprising:

a. an outer frame member having a front side, a back side and a cavity therethrough, wherein a backward facing inner edge is provided adjacent to the front side;

b. a first inner frame member shaped to be fitted within said cavity of said outer frame member and having a front side, a back side, an opening therethrough, and a first extending portion surrounding the opening;

c. a transparent member shaped to be fitted within said cavity of said outer frame member and assembled between said inner edge of said outer frame member and said front side of said first inner frame member;

d. a second inner frame member shaped to be fitted within said cavity of said outer frame member and having a front side, a back side, an opening therethrough, and a second extending portion surrounding the opening;

e. said first extending portion of said first inner frame member and said second extending portion of said second inner frame member for holding said at least one glass etching therebetween;

f. at least one spacer member positioned between said back side of said first inner frame member and said front side of said second inner frame member, and for holding in position and surrounding said at least one glass etching;

g. an illuminating means positioned between said back side of said first inner frame member and said front side of said second inner frame member and surrounding said at least one spacer member for illuminating said at least one glass etching through said at least one spacer member;

h. means for covering said illuminating means for adsorbing heat generated therefrom;

i. a backing member also shaped to be fitted within said cavity of said outer frame member and positioned adjacent to said back side of said outer frame member for holding said artwork as said background between said back side of said second inner frame member and the backing member; and j. means for securing said backing member to said outer frame member.

10. The frame as defined in claim 9 further comprising a perimeter insert which is shaped to be assembled within said cavity of said outer frame member and between said transparent member and said front side of said first inner frame member, and having an opening therethrough.

11. The frame as defined in claim 9 further comprising at least two hanging members for hanging the frame.

12. The frame as defined in claim 9 wherein said illuminating means is a light strip bent and positioned between said back side of said first inner frame member and said front side of said second inner frame member and surrounding said at least one spacer member for illuminating said at least one glass etching through said at least one spacer member.

13. The frame as defined in claim 9 wherein said means for covering said illuminating means is a heat resistance resin material.

14. The frame as defined in claim 9 wherein said transparent member is made of glass.

15. The frame as defined in claim 9 wherein said at least one spacer member is made of transparent plastic material.

16. The frame as defined in claim 9 wherein said outer frame member is made of wooden material.

17. A frame for displaying at least one glass etching with an artwork, comprising:

a. an outer frame member having a front surface and a cavity therethrough, wherein an inner edge is provided adjacent to the front surface;

b. a first inner frame member assembled within said cavity of said outer frame member and having an opening therethrough;

c. a transparent member assembled within said cavity of said outer frame member and located between said inner edge of said outer frame member and said first inner frame member;

d. a second inner frame member assembled within said cavity of said outer frame member and having an opening therethrough;

e. said first inner frame member and said second inner frame member for holding said at least one glass etching therebetween;

f. an illuminating means positioned between said first inner frame member and said second inner frame member for illuminating said at least one glass etching, and having means for absorbing heat generated therefrom;

g. a backing member assembled within said cavity of said outer frame member for holding said artwork between said second inner frame member and the backing member; and h. means for securing said backing member to said outer frame member.

18. The frame as defined in claim 17 further comprising at least one transparent spacer member assembled between said first inner frame member and said second inner frame member, and thereby held in position and surrounding said at least one glass etching for illuminating through the at least one transparent spacer member.

19. The frame as defined in claim 17 further comprising a perimeter insert which is shaped to be assembled within said cavity of said outer frame member and between said transparent member and said first inner frame member, and having an opening therethrough.

20. The frame as defined in claim 17 wherein said illuminating means is generally a flexible light strip which is bent and positioned between said first inner frame member and said second inner frame member.

21. The frame as defined in claim 17 wherein said means for absorbing heat is a heat resistance resin material.

* * * * *